US008235680B2

(12) United States Patent
Pecorari et al.

(10) Patent No.: US 8,235,680 B2
(45) Date of Patent: Aug. 7, 2012

(54) HYDRAULIC MOTOR HAVING RADIAL CYLINDERS AND CONTINUOUS VARIABLE DISPLACEMENT

(75) Inventors: Vittorio Pecorari, Modena (IT); Davide Pecorari, Modena (IT); Gabriele Pecorari, Modena (IT)

(73) Assignee: S.A.I. Societa' Apparecchiature Idrauliche S.p.A., Modena (IT)

( * ) Notice: Subject to any disclaimer, the term of this patent is extended or adjusted under 35 U.S.C. 154(b) by 805 days.

(21) Appl. No.: 12/226,408

(22) PCT Filed: Apr. 20, 2006

(86) PCT No.: PCT/IT2006/000267

§ 371 (c)(1),
(2), (4) Date: Feb. 26, 2009

(87) PCT Pub. No.: WO2007/122643

PCT Pub. Date: Nov. 1, 2007

(65) Prior Publication Data

US 2009/0151551 A1 Jun. 18, 2009

(51) Int. Cl.
*F01B 13/06* (2006.01)

(52) U.S. Cl. ..... 417/269; 91/497

(58) Field of Classification Search ..... 417/269; 91/497

See application file for complete search history.

(56) References Cited

U.S. PATENT DOCUMENTS

| | | | | |
|---|---|---|---|---|
| 5,368,448 | A * | 11/1994 | Maruno et al. | 417/221 |
| 6,467,557 | B1 * | 10/2002 | Krueger et al. | 175/45 |
| 6,578,296 | B2 * | 6/2003 | Kimoto et al. | 37/443 |
| 2005/0172799 | A1 * | 8/2005 | Kadlicko | 92/71 |

FOREIGN PATENT DOCUMENTS

| | | | |
|---|---|---|---|
| DE | 10 2004 048174 | A1 | 4/2006 |
| EP | 0 267 656 | A2 | 5/1988 |
| EP | 0 685 647 | A2 | 12/1995 |
| EP | 1 624 185 | A | 2/2006 |
| WO | WO 99/17021 | A | 4/1999 |

* cited by examiner

*Primary Examiner* — Tracie Y Green
(74) *Attorney, Agent, or Firm* — McGinn IP Law Group, PLLC

(57) ABSTRACT

A radial cylinder hydraulic motor having continuously variable displacement capabilities includes: oscillating hydraulic cylinders which are driven to oscillate through an eccentric crankpin formed on the motor shaft and carrying a radially movable ring adapted to be shifted along the radial direction of the crankpin by actuation of opposed counteracting hydraulic cylinders housed within the crankpin; a hydraulic control circuit for controlling and adjusting the positions of said counteracting hydraulic cylinders in a continuous manner; an electronic control circuit adapted to control the hydraulic control circuit and process signals from at least one position sensor arranged to detect the positions of said oscillating cylinders; a rotary joint for hydraulic conduits through which said counteracting hydraulic cylinders are controlled and adjusted.

20 Claims, 3 Drawing Sheets

HYDRAULIC MOTOR HAVING RADIAL CYLINDERS AND CONTINUOUS VARIABLE DISPLACEMENT

FIELD OF APPLICATION

The present invention relates to a radial cylinder hydraulic motor with a continuously variable displacement feature, in particular a hydraulic motor having oscillating radial cylinders whose displacement can be adjusted in a continuous manner without stopping the motor, and having high rotational rate capabilities. The invention also covers the provision of sensors and control electronics for varying the motor displacement, as well as of a rotary connection for hydraulic supply conduits to the counteracting hydraulic cylinders located in the motor crankpin.

PRIOR ART

Continuously variable displacement, hydraulic motors have been known wherein radially arranged cylinders act on a common, centrally located crankpin or eccentric, and wherein a radially movable ring can be shifted along the crankpin to increase or decrease the throw. The ring is adapted to vary the total displacement of the hydraulic motor cylinders by a change of eccentricity achieved through counteracting hydraulic cylinders provided within the crankpin. Conventional variable displacement, radial cylinder hydraulic motors further include cross-linked check valves arranged to cut off the counteracting cylinders inside the crankpin and retain a displacement value set thereby.

It is a recognized fact, moreover, that for the same flow rate, the rotational speed of a hydraulic motor varies inversely as its displacement, so that the motor can be used in applications where, for a given input of power, the operating parameters of the motor are to vary over a wide range well outside the change in input power represented by the flow rate and pressure parameters of the hydraulic fluid.

Furthermore, recent motor designs have been proposed, specifically of the oscillating cylinder type, which are equipped with sensors arranged to detect the actual positions of the cylinders, and therefore, univocally set the motor displacement and afford improved control of the motor working state.

Finally, electronic control circuits are known whereby the detected parameters can be controlled and adjusted by acting on the pressures to the counteracting hydraulic cylinders inside the crankpin.

However, such prior approaches include detecting the speed of rotation and amplitude of oscillation, the latter through inductive sensors that disallow an accurate and economically convenient determination of position. Other approaches provide for a measurement of parameters, such as the hydraulic fluid pressure and the motor rpm, and for the mechanical power acting on the motor to be calculated and adjusted.

The above prior approaches are cost-intensive and of little use in high rotational speed applications. Radial cylinder hydraulic motors are inherently slow, and unsuitable for applications that require good performance both at low rotational speeds, i.e. at high or maximum displacement, and at high speeds, i.e. at decreased or minimum displacement, with an attendant minimal swing of the oscillating cylinders.

The limitations to the state of the art altogether preclude any acceptable degree of flexibility in the motor operation, a wide range of speed variability, and the retention of suitable performance levels. Accordingly, no corresponding variation in the torque delivered at top output power is achievable which can be the same at both low and high rpm, i.e. no torque which be tied to the hydraulic fluid pressure and unaffected by constraints on the motor rpm.

Thus, the underlying technical problem of this invention is to provide a radial cylinder hydraulic motor whose displacement variation can be controlled externally of the motor with a high degree of accuracy in a cost-effective way.

Another object of the invention is to provide a hydraulic motor with a mechanical means of varying its displacement in a simple and effective way, while minimizing the hydraulic losses through the displacement control system.

A not least object of the invention is to provide a distributor arrangement that can operate with the utmost accuracy, this feature being especially important where the motor is operated at reduced displacement under a reduced flow rate condition.

SUMMARY OF THE INVENTION

The above problem is solved, and the invention objects are achieved, by a radial cylinder hydraulic motor having continuously variable displacement capabilities and comprising: oscillating hydraulic cylinders which are driven to oscillate through an eccentric crankpin formed on the motor shaft and carrying a radially movable ring adapted to be shifted along the radial direction of the crankpin by actuation of opposed counteracting hydraulic cylinders housed within the crankpin; a hydraulic control circuit for controlling and adjusting the positions of said counteracting hydraulic cylinders in a continuous manner; an electronic control circuit adapted to control the hydraulic control circuit and process signals from at least one position sensor arranged to detect the positions of said oscillating cylinders; and a rotary joint for the hydraulic conduits through which said counteracting hydraulic cylinders are controlled and adjusted; characterized in that said sensor is an angular position sensor placed close to the oscillation axis of at least one oscillating cylinder to measure, based upon changes in the signal, an angular position currently entered by the cylinder liner during the swing.

In a preferred embodiment, the angular position signals are supplied in the hydraulic motor by two angular position sensors mounted on two adjacent cylinders in the radial row to subtend a minimum angle of 40 degrees and a maximum angle of 120 degrees.

In another embodiment, the hydraulic motor has the angular position sensor mounted coaxially with the trunnion of the oscillating cylinder liner, and includes a rotary joint placed between the sensor pivot and the trunnion end, as well as arrangements for sealing the fluid inside the motor.

In a preferred embodiment, said joint in the hydraulic motor comprises: a sleeve being an interference fit on the sensor end of the cylinder trunnion in coaxial relationship therewith; a face joint mounted on the sensor pivot and keyed for rotation therewith by a drive pin which is received in the axial groove of the joint; the joint legs including axial drive pins which are received in radial recesses formed in the outer end of said sleeve.

In a further preferred embodiment, the rotary joint for the hydraulic supply conduits to the counteracting hydraulic cylinders, in the hydraulic motor, comprises a respective annular groove formed in the inside diameter of the motor cover at a location close to a drive pin of the distributor; wherein each annular groove is communicated hydraulically to a respective conduit and terminated at its pin end with a respective sealing bush which is set in the cover and engaged rotatively by said drive pin, being each formed with an annular groove which is communicated to the corresponding annular groove in the cover; and wherein side seals in the respective bush and radial communication holes to the hydraulic feed conduits are provided.

In an improved embodiment of the hydraulic motor, the side seals are ring seals received each in a corresponding one of the annular grooves that extends at one side of the annular groove arranged to distribute the hydraulic fluid over the surface of the pin.

In a further improved embodiment of the hydraulic motor, one of the two bushes is formed with at least one small axial hole through the bush thickness, from one side wall to the opposite side wall thereof, so as not to encroach on the annular groove, in order to communicate the gap in the side contact area between the two bushes with the inner chamber of the motor.

The features and advantages of this invention, relating to a radial cylinder hydraulic motor whose displacement can be varied continually, should be apparent from the following description of embodiments thereof, given by way of non-limitative examples with reference to the three accompanying drawing sheets.

DETAILED DESCRIPTION OF A PREFERRED EMBODIMENT

Figure 1:
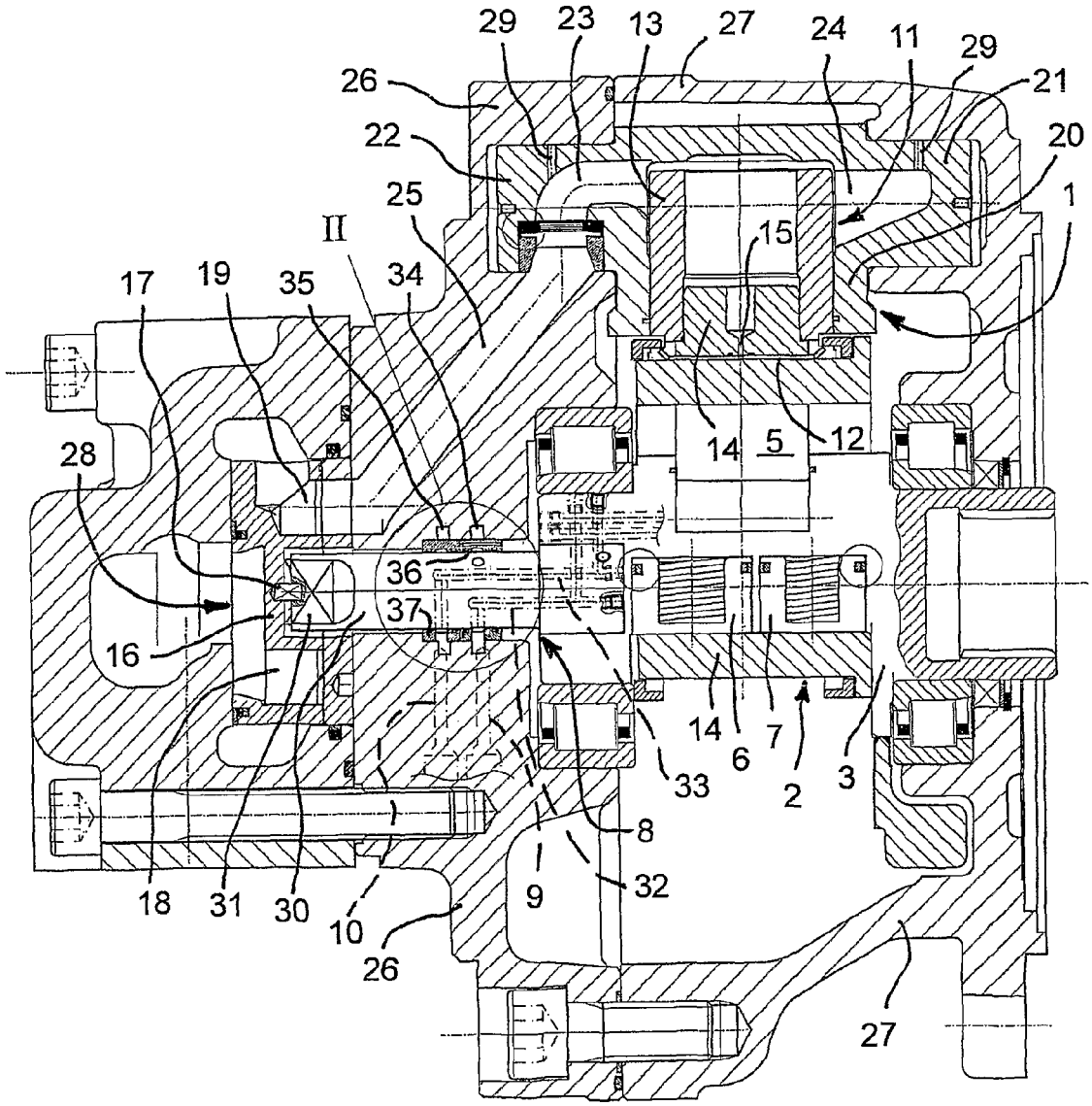
FIG. 1 is a sectional view of a hydraulic motor embodying this invention, i.e. comprising component parts to be described.

Shown in FIG. 1 is a radial cylinder hydraulic motor having continuous displacement variation capabilities and oscillating hydraulic cylinders 1 which are driven to swing through an eccentric crankpin 2 of a crankshaft 3 having a radially movable ring 4 mounted thereon, the ring 4 being shifted along the radial direction of the crankpin by actuation of opposed counteracting hydraulic cylinders 5, 6 and 7 housed inside the crankpin 2; and a rotary joint 8 for hydraulic feed conduits 9 and 10 to said counteracting hydraulic cylinders. The pistons 11 are conventionally provided with a runner 12 for sliding over the outer surface of the movable ring 4; the pistons further comprise a sleeve 13 which is secured on the piston base 14 to which the runner 12 is attached conventionally; the base 14 is formed with an inlet hole 15 for the pressurized fluid which is conventionally employed to lubricate the runner 12.

FIG. 1 also shows the liner 20 of the oscillating cylinder 1 having supporting oscillation 21 and supporting/feed trunnions 22; the supporting/feed trunnion, hereinafter also referred to as the feed trunnion 22, is formed with a channel 23 oscillating with the trunnion that interconnects the cylinder chamber 24 and the fluid supply channel 25, which extends through the thickness of the cover 26 of the motor body 27 from the distributor 28 arranged to rotate synchronously with the motor shaft 3; the oscillating channel 23 and chamber 24 are formed with lubrication passages 29 to the portions of the trunnions 21 and 22 that are borne pivotally in respective journals in the cover and the body of the motor.

The rotating distributor 28 is connected to the motor shaft with the drive pin 30 by a drive coupling 31; it is also held accurately aligned between said pin 30 and the rotating disk 16 of the distributor by the centring pin 17; the disk is formed with conventional ports 18 and 19 for feeding the respective oscillating cylinders 1 at appropriate timing.

The other end of the pin 30 is conventionally engaged with the motor shaft 3 for rotation therewith, holes being provided in the motor shaft and the pin to interconnect the axial inlet channels 32 and 33 for the pressurized fluid used to control and adjust the positions of the counteracting cylinders 5, 6 and 7. The control/adjustment fluid is admitted, between the channels 9 and 10 formed in the motor cover 26 and the axial channels 32 and 33 formed in the drive pin 30, through the rotary joint 8 of the hydraulic conduits comprising a respective annular groove 34 and 35 formed in the inside diameter of the cover close to said pin 30; and each annular groove is communicated hydraulically to the respective conduit 9 or 10 and terminated on the pin side by a respective sealing bush 36 and 37 held firmly in the cover 26 and coupled rotatively to said drive pin 30.

Figure 2:
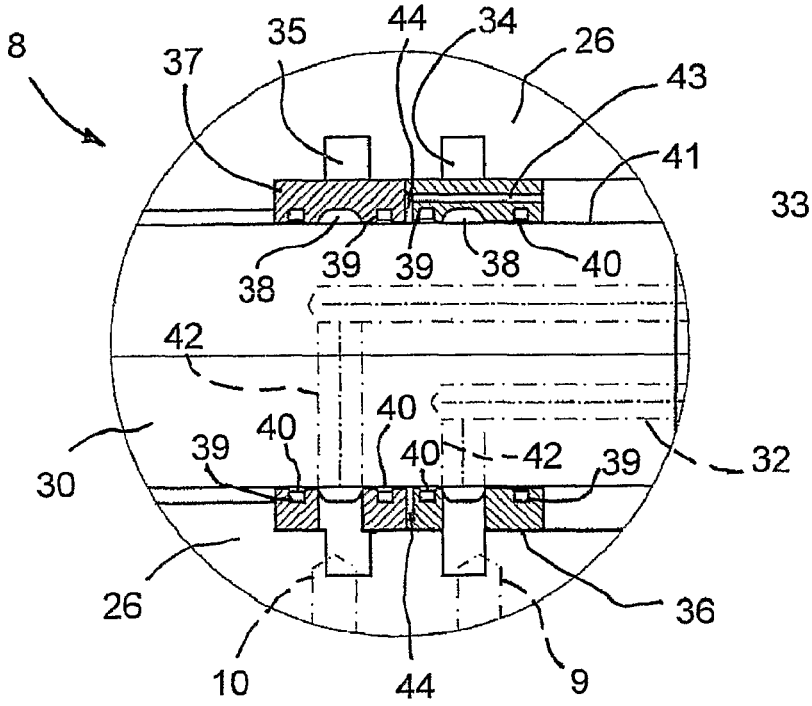
FIG. 2 is an enlarged sectional view of an area II in FIG. 1, illustrating the improved rotary joint for the pressure conduits to the counteracting cylinders that are provided inside the crankpin for varying the motor displacement.

FIG. 2 shows more parts of the rotary joint 8 of the hydraulic conduits, with the bushes 36 and 37 formed with respective annular recesses 38, themselves provided at either sides with annular seats 39 for a respective ring seal 40; the pressurized fluid from the channels 9 and 10 is, after flowing through the annular grooves 34 and 35 and the respective annular grooves 38 in the bushes 36 and 37, directed to the surface 41 of the drive pin 30 by the ring seals 40 and into a respective radial hole 42, itself communicated hydraulically to the respective axial channel 32 or 33 in the pin. One of the two bushes 36 is formed with a small axial hole 43 through the bush thickness, from one side wall to the opposite side wall, such that it does not encroach on the annular groove 38, in order to connect the gap 44 in the side contact area between the two bushes to the inner chamber of the motor; thus, any fluid leakout would be directed to a common sump within the motor.

Figure 3:
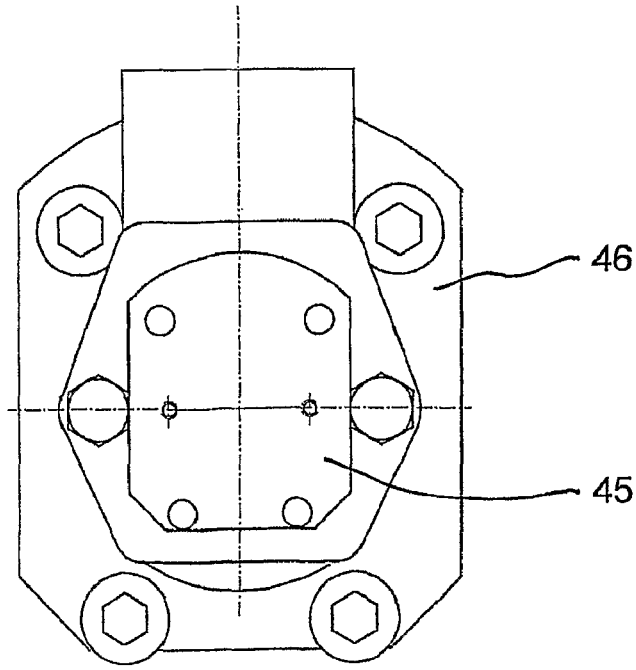
FIG. 3 shows the exterior of a sensor adapted to detect the current position of an oscillating cylinder according to the invention, as viewed in an axial direction.
Figure 4:
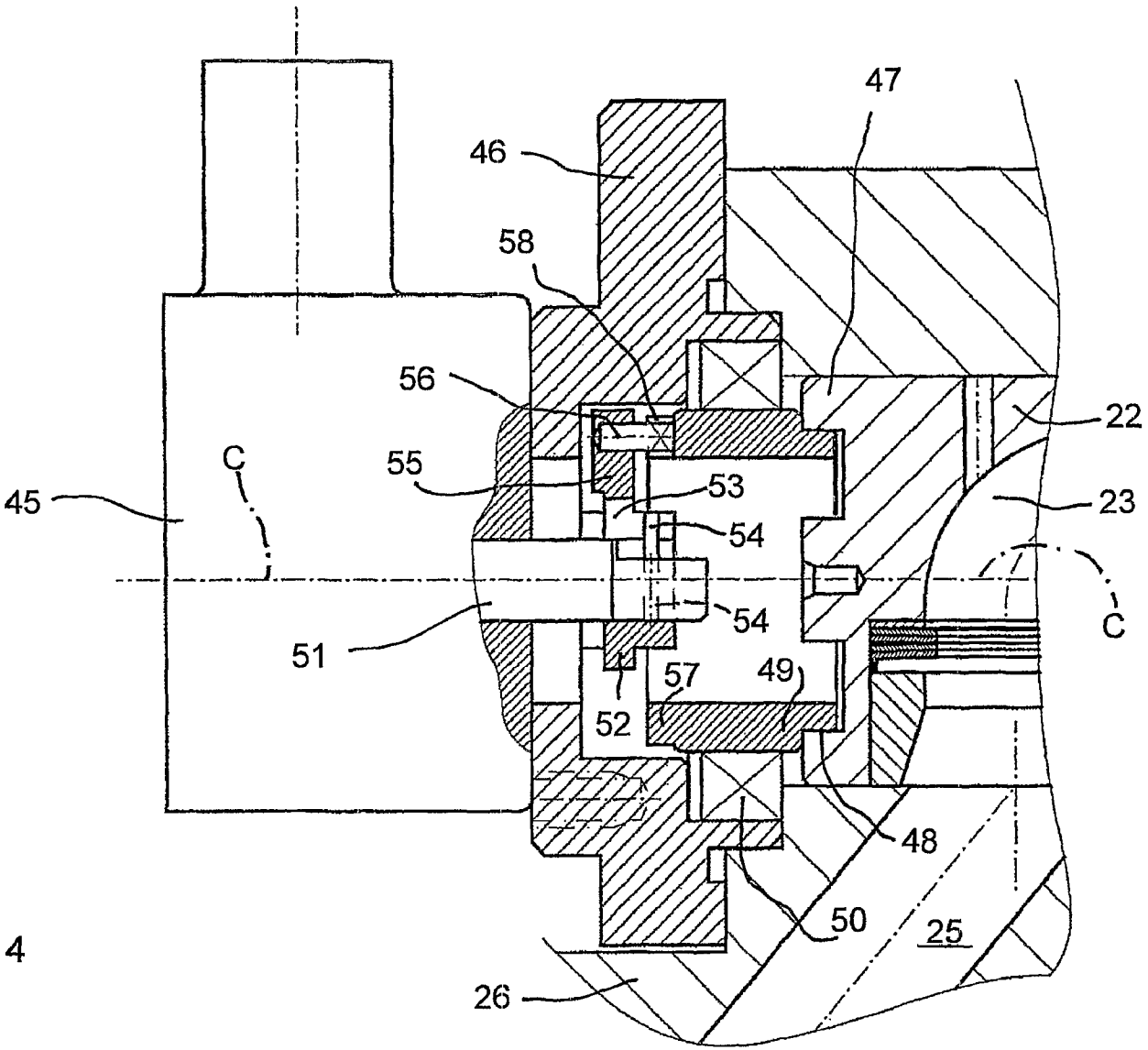
FIG. 4 is an axial section view of the connection of a sensor for detecting the current position of an oscillating cylinder according to the invention, incorporating an improved embodiment of the hydraulic cylinder liner trunnions.

FIGS. 3 and 4 show the angular position sensor 45 mounted on the flange 46 which is received close to the end of the feed trunnion 22 with a modified end 47. The end of the feed trunnion has a centring diameter 48 to which a sleeve 49 is clamped to turn rigidly with the trunnion, a ring seal 50 of the flange 46 being provided to encircle the outside diameter of the sleeve 49. The pivot 51 of the angular position sensor is received approximately coaxially with the axis C of the feed trunnion; a face joint 52 is keyed and movable axially on the end of the sensor pivot, which joint is formed with an axial groove 53 and receives a sliding pin 54 mounted radially on said sensor pivot 51. The face joint has a guide pin 56 mounted axially on each radial leg 55 thereof, which pin is facing the outer end of said sleeve 49 to engage in the respective radial recess 58 of said outer end.

Associated with the motor, though not illustrated, are a hydraulic circuit arranged to control and adjust the positions of said counteracting hydraulic cylinders, and an electronic control circuit arranged to control the hydraulic circuit and process the signals from at least one position sensor of said oscillating cylinders.

The rotary joint 8 for the hydraulic conduits works by the bushes 36 and 37, respectively, being formed with annular grooves 38 to direct the pressurized fluid for controlling and adjusting the counteracting cylinders onto the surface 40 of the drive pin 30. The ring seals 40 in the annular seats 39 terminate the cylindrical regions of the pin surface 41 where the fluid flows and the respective radial holes 42 are provided to hydraulically connect the channels 9 and 10, through the respective annular grooves 38 and radial holes 42, to the axial channels 32 and 33 in the pin. Also, at least one of the two bushes 36, 37 is formed with a small axial hole 43 through the bush thickness from one side wall to the opposite side wall; fluid leakouts to the gap 44 can be drained into the motor, thereby preventing overpressures from occurring in the side contact area between the two bushes. The bushes 36 and 37 are an interference fit in the seat on the cover 26 to seal off the annular grooves 34 and 35; in addition, the bushes are surface hardened on the their inside diameter, i.e. the diameter in rubbing contact with said drive pin 30.

The operation of the position sensor 45 is linked to the rotation of the oscillating feed trunnion 22, the sensor being advantageously an angular position sensor adapted to sense precisely even the slightest oscillation of the cylinder at the smallest possible displacement setting. The drive is applied through a face joint and a dual coupling of the face joint 52 to the sensor pivot 51 and of the face joint arms 55 to the end portion 59 of the rotary connection sleeve. The assembly described above, additionally to providing for precise angular positioning in operation, is also effective to compensate for slight misalignment of the sensor pivot 51 relative to the oscillation axis C of the trunnion 22. The assembly further allows the sensor to be replaced without opening the motor by just taking the pivot 51 and radial pin 54 off the seat in the face joint 52. The current data from the angular position sensor and the data from the rotational speed sensor is conventionally processed in the electronic control/adjustment circuit for setting the displacement variation in accordance with the control logic of the machine on which the motor is installed.

Of course, a skilled person in the art may variously modify the radial cylinder hydraulic motor described hereinabove in order to fill contingent demands, such modifications being encompassed by the proprietorial capacity of this invention as set forth in the following claims.

The invention claimed is:

1. A radial cylinder hydraulic motor having continuously variable displacement capabilities and comprising:

oscillating hydraulic cylinders which are driven to oscillate through an eccentric crankpin formed on the motor shaft and carrying a radially movable ring adapted to be shifted along the radial direction of the crankpin by actuation of opposed counteracting hydraulic cylinders housed within the crankpin;

a hydraulic control circuit for controlling and adjusting the positions of said counteracting hydraulic cylinders in a continuous manner;

an electronic control circuit adapted to control the hydraulic control circuit and process signals from at least one position sensor arranged to detect the positions of said oscillating cylinders; and a rotary joint for hydraulic conduits through which said counteracting hydraulic cylinders are controlled and adjusted;

wherein the sensor comprises an angular position sensor placed close to the oscillation axis of at least one oscillating cylinder to measure, based upon changes in the signal, an angular position currently entered by the cylinder liner during the swing;

wherein the rotary joint for hydraulic conduits comprises a respective annular groove formed in the inside diameter of a cover of the motor at a location close to a drive pin;

wherein each annular groove is communicated hydraulically to a respective conduit and terminated at its pin end with a respective sealing bush which is set in the cover and engaged rotatively by said drive pin, being each formed with an annular groove which is communicated to the corresponding annular groove in the cover; and wherein the respective sealing bush comprises a side seal, and the drive pin comprises a radial communication hole in communication with the hydraulic feed conduits.

2. A hydraulic motor according to claim 1, wherein the angular position signals are supplied by two angular position sensors mounted on two adjacent cylinders in the radial row to subtend a minimum angle of 40 degrees and a maximum angle of 120 degrees.

3. A hydraulic motor according to claim 1, wherein the angular position sensor is mounted coaxially with the trunnion of the oscillating cylinder liner, a rotary joint arrangement between the sensor pivot and the trunnion end, and arrangements for sealing the fluid inside the motor, being also provided.

4. A hydraulic motor according to claim 3, wherein said joint arrangement comprises:

a sleeve being an interference fit on the sensor end of the cylinder trunnion in coaxial relationship with said trunnion; a face joint mounted on the sensor pivot and keyed for rotation therewith by a drive pin which is received in the axial groove of the joint; the joint legs including axial drive pins which are received in radial recesses formed in the outer end of said sleeve.

5. A hydraulic motor according to claim 1, wherein the side seals comprise ring seals received each in a corresponding one of the annular grooves that extends at one side of the annular groove arranged to distribute the hydraulic fluid over the surface of the pin.

6. A hydraulic motor according to claim 5, wherein one of the two bushes is formed with at least one small axial hole through the bush thickness, from one side wall to the opposite side wall thereof, so as not to encroach on the annular groove, in order to communicate the gap in the side contact area between the two bushes with the inner chamber of the motor.

7. A hydraulic motor according to claim 5, wherein said bushes are an interference fit in the seat on the cover to seal off the annular grooves; and wherein the bushes are surface hardened on their inside diameter, the inside diameter being in rubbing contact with the drive pin.

8. A hydraulic motor according to claim 1, wherein a drive pin of a disk distributor is connected by a dowel pin in an axial direction to inhibit movement of the drive joint in the radial direction relative to the disk.

9. A hydraulic motor according to claim 6, wherein said bushes are an interference fit in the seat on the cover to seal off the annular grooves; and wherein the bushes are surface hardened on their inside diameter, the inside diameter being in rubbing contact with the drive pin.

10. A hydraulic motor according to claim 2, wherein a drive pin of a disk distributor is connected by a dowel pin in an axial direction to inhibit movement of the drive joint in the radial direction relative to the disk.

11. A hydraulic motor according to claim 3, wherein a drive pin of a disk distributor is connected by a dowel pin in an axial direction to inhibit movement of the drive joint in the radial direction relative to the disk.

12. A hydraulic motor according to claim 4, wherein a drive pin of a disk distributor is connected by a dowel pin in an axial direction to inhibit movement of the drive joint in the radial direction relative to the disk.

13. A hydraulic motor according to claim 5, wherein a drive pin of a disk distributor is connected by a dowel pin in an axial direction to inhibit movement of the drive joint in the radial direction relative to the disk.

14. A hydraulic motor according to claim 6, wherein a drive pin of a disk distributor is connected by a dowel pin in an axial direction to inhibit movement of the drive joint in the radial direction relative to the disk.

15. A hydraulic motor according to claim 7, wherein a drive pin of a disk distributor is connected by a dowel pin in an axial direction to inhibit movement of the drive joint in the radial direction relative to the disk.

16. A radial cylinder hydraulic motor, comprising:

a motor shaft;

an eccentric crankpin formed on the motor shaft;

opposed counteracting hydraulic cylinders housed within the crankpin;

a rotary joint which forms a hydraulic conduit through which the counteracting hydraulic cylinders are controlled and adjusted;

a drive pin comprising a radial communication hole in communication with the hydraulic conduit, the rotary joint comprising an annular groove formed in a cover of the motor at a location adjacent to the drive pin; and a sealing bush which is set in the cover and engaged rotatively by the drive pin, the annular groove of the rotary joint being communicated hydraulically to the hydraulic conduit and terminated at its pin end with the sealing bush, and the sealing bush comprising an annular groove which is communicated to the annular groove of the rotary joint.

17. The hydraulic motor of claim 16, wherein the sealing bush comprises an axial hole through the bush thickness, extending from a side wall of the bush to opposite side wall of the bush, so as not to encroach on the annular groove of the rotary joint.

18. The hydraulic motor of claim 17, wherein the sealing bush comprises a plural sealing bushes, and the axial hole communicates a gap between the plural sealing bushes with an inner chamber of the motor.

19. The hydraulic motor of claim 16, wherein the sealing bush is formed by an interference fit in a seat on the cover to seal off the annular groove of the rotary joint.

20. The hydraulic motor of claim 16, wherein an inner surface of the sealing bush which is in rubbing contact with the drive pin is surface hardened.

* * * * *